US010786891B2

(12) United States Patent
Noguchi et al.

(10) Patent No.: US 10,786,891 B2
(45) Date of Patent: Sep. 29, 2020

(54) DRIVER

(71) Applicant: KOKI HOLDINGS CO., LTD., Tokyo (JP)

(72) Inventors: Yuta Noguchi, Ibaraki (JP); Hironori Mashiko, Ibaraki (JP); Takashi Ueda, Ibaraki (JP)

(73) Assignee: KOKI HOLDING CO., LTD., Tokyo (JP)

( * ) Notice: Subject to any disclaimer, the term of this patent is extended or adjusted under 35 U.S.C. 154(b) by 91 days.

(21) Appl. No.: 16/314,320

(22) PCT Filed: May 26, 2017

(86) PCT No.: PCT/JP2017/019712
§ 371 (c)(1),
(2) Date: Dec. 28, 2018

(87) PCT Pub. No.: WO2018/003370
PCT Pub. Date: Jan. 4, 2018

(65) Prior Publication Data

US 2019/0202043 A1 Jul. 4, 2019

(30) Foreign Application Priority Data

Jun. 30, 2016 (JP) ..... 2016-131138
Sep. 16, 2016 (JP) ..... 2016-181861

(51) Int. Cl.
*B25C 1/04* (2006.01)
*B25C 1/06* (2006.01)

(52) U.S. Cl.
CPC ..... *B25C 1/047* (2013.01); *B25C 1/04* (2013.01); *B25C 1/041* (2013.01); *B25C 1/06* (2013.01)

(58) Field of Classification Search
CPC .. B25C 1/00; B25C 1/04; B25C 1/041; B25C 1/046; B25C 1/047; B25C 1/06
(Continued)

(56) References Cited

U.S. PATENT DOCUMENTS 3,847,322 A * 11/1974 Smith ..... B25C 1/06 227/132
4,724,992 A * 2/1988 Ohmori ..... B25C 1/005 227/132
(Continued)

FOREIGN PATENT DOCUMENTS

JP 2011-056613 A 3/2011
JP 2013-233608 A 11/2013
(Continued)

OTHER PUBLICATIONS

International Search Report (ISR) issued in International Application No. PCT/JP2017/019712 dated Aug. 8, 2017.
(Continued)

*Primary Examiner* — Scott A Smith
(74) *Attorney, Agent, or Firm* — McDermott Will & Emery LLP

(57) ABSTRACT

A driver has: a wheel that is rotationally driven by an electric motor; pins provided to the wheel and arranged along a circumferential direction of the wheel; a piston reciprocably housed in a cylinder; a driver blade that integrally reciprocates with the piston; racks provided to the driver blade along an axial direction of the driver blade; and a controller configured to control a drive of the electric motor by PWM. The controller changes a duty ratio of the switching element provided on a power supply line for the electric motor in response to a change in remaining battery level as one of situations that affects a moving speed of the piston from the bottom dead point side to the top dead point side.

10 Claims, 9 Drawing Sheets

(58) Field of Classification Search
USPC .... 227/8, 120, 130, 131, 142, 146, 129, 156
See application file for complete search history.

(56) References Cited

U.S. PATENT DOCUMENTS

| | | | | |
|---|---|---|---|---|
| 4,834,278 | A * | 5/1989 | Lin | B25C 1/06 227/131 |
| 5,720,423 | A * | 2/1998 | Kondo | B25C 1/04 227/130 |
| 5,927,585 | A * | 7/1999 | Moorman | B25C 5/15 173/203 |
| 6,971,567 | B1 * | 12/2005 | Cannaliato | B25C 1/06 173/1 |
| 6,997,367 | B2 * | 2/2006 | Hu | B25C 1/06 173/202 |
| 7,152,774 | B2 * | 12/2006 | Chen | B25C 1/06 227/131 |
| 7,537,146 | B2 * | 5/2009 | Schiestl | B25C 1/06 227/131 |
| 8,011,547 | B2 * | 9/2011 | Leimbach | B25C 1/041 227/8 |
| 8,763,874 | B2 * | 7/2014 | McCardle | B25C 1/047 227/129 |
| 9,868,196 | B2 * | 1/2018 | Chien | B25C 1/047 |
| 9,962,821 | B2 * | 5/2018 | Pedicini | B25C 1/06 |
| 10,569,403 | B2 * | 2/2020 | Namouz | B25C 1/06 |
| 2002/0104869 | A1 * | 8/2002 | Garvis | B25C 1/06 227/138 |
| 2006/0180631 | A1 * | 8/2006 | Pedicini | B25C 1/06 227/130 |
| 2008/0121404 | A1 * | 5/2008 | Spasov | B25C 1/06 173/202 |
| 2009/0090759 | A1 | 4/2009 | Leimbach et al. | |
| 2009/0179062 | A1 | 7/2009 | Shima et al. | |
| 2011/0198381 | A1 * | 8/2011 | McCardle | B25C 1/06 227/8 |
| 2013/0161373 | A1 | 6/2013 | Schiestl | |
| 2015/0158160 | A1 | 6/2015 | Kato | |
| 2015/0202755 | A1 | 7/2015 | Tanji | |
| 2015/0217436 | A1 | 8/2015 | Yanagihara et al. | |
| 2016/0288305 | A1 * | 10/2016 | McCardle | B25C 1/06 |

FOREIGN PATENT DOCUMENTS

| | | |
|---|---|---|
| JP | 2014-069289 A | 4/2014 |
| JP | 2014-104534 A | 6/2014 |

OTHER PUBLICATIONS

Extended European Search Report issued in corresponding European Patent Application No. 17819737.2-1017, dated Jun. 5, 2020.

* cited by examiner

1 : DRIVER
10 : CYLINDER
11 : PISTON
30 : DRIVER BLADE
32 : RACK
50 : WHEEL
52 : PIN

DRIVER

CROSS REFERENCE

This application is the U.S. National Phase under 35 U.S.C. § 371 of International Application No. PCT/JP2017/019712 filed on May 26, 2017, which claims the benefit of Japanese Application Nos. 2016-131138 filed on Jun. 30, 2016 and 2016-181861 filed on Sep. 16, 2016, the entire contents of each are hereby incorporated by reference.

TECHNICAL FIELD

The present invention relates to a driver configured to drive a stopper such as nail or pin into an object such as wood or gypsum board.

BACKGROUND ART

A driver has: a piston reciprocably housed in a cylinder; and a driver blade integral with the piston. The piston reciprocates within the cylinder between a top dead point and a bottom dead point, and the driver blade reciprocates with the piston. The driver further includes a supply mechanism for supplying a stopper on a route of the driver blade. The supply mechanism supplies a stopper to an injection passage when the driver blade moves up to a predetermined position with the movement of the piston from the bottom dead point to the top dead point. Then, when the driver blade moves down with the movement of the piston from the top dead point to the bottom dead point, the stopper waiting in the injection passage is hit by the driver blade, driven out of an injection port which is an outlet of the injection passage, and driven into wood, gypsum board, or the like.

There is known a driver using a gas spring as means for reciprocating the piston as described above. In this driver, the piston is driven by an electric motor so as to move from the bottom dead point to the top dead point, and moves from the top dead point to the bottom dead point by air pressure. For example, a plurality of racks is provided to the driver blade and arranged along the axial direction of the side surface of the driver blade. A wheel to be driven so as to be rotated by the electric motor is provided in the vicinity of the driver blade, and a plurality of pins is provided along the circumferential direction of the wheel. When the wheel is rotated, each pin of the wheel is sequentially engaged with a corresponding rack of the driver blade. More specifically, the wheel is provided with a first pin, a second pin furthest away from the first pin in a rotation direction of the wheel, and a multiple of third pins arranged between the first pin and the second pin. When the wheel is rotated, the first pin first is engaged with the rack of the driver blade. Then, a third pin adjacent the first pin is engaged with the next rack and another third pin adjacent the third pin is engaged with the next rack. Then, the respective third pins are sequentially engaged with the respective racks to push up the driver blade. As a result, the piston integral with the driver blade moves (rises) from the bottom dead point to the top dead point in the cylinder.

Then, when the piston reaches the top dead point, the engagement between the second pin and the rack is released. That is, the second pin is the last pin to be engaged with the rack during one cycle, and may be referred to as the "last pin" in the following description. Also, the rack engaged with the second pin may be referred to as the "last rack".

When the last pin is disengaged from the last rack, the piston is moved from the top dead point toward the bottom dead point by the pressure of air compressed in the cylinder with upward movement of the piston. With this movement of the piston, the driver blade moves down, and the stopper is hit by the driver blade.

RELATED ART DOCUMENTS

Patent Documents

Patent Document 1: Japanese Patent Application Laid-Open Publication No. 2014-069289

SUMMARY OF THE INVENTION

Problems to be Solved by the Invention

In the above-mentioned driver, the moving speed and the stop position of the piston in the cylinder is varied depending on the status. For example, when the electric motor is powered by a battery, that is, when the driver is cordless, the moving speed of the piston from the bottom dead point to the top dead point changes depending on the remaining battery level. Specifically, with decrease in remaining battery level, the driving force of the electric motor decreases, and the moving speed of the piston from the bottom dead point to the top dead point decreases. In addition, the moving speed of the piston from the bottom dead point to the top dead point is also increased or decreased by the pressure change in the cylinder. More specifically, when the pressure in the cylinder is high, the load of the electric motor becomes large and the moving speed of the piston becomes slow. On the other hand, when the pressure in the cylinder is low, the load of the electric motor becomes small and the moving speed of the piston becomes fast. The pressure change in the cylinder occurs, for example, with a change in temperature of air in the cylinder due to a change in the ambient temperature or a decrease in the air pressure in the cylinder. As a result, the stop position of the electric motor also changes due to such a change in the moving speed. Therefore, in such a driver, it is required to appropriately monitor the moving speed of the piston and the operation of the electric motor and control them so as to achieve a desired operation.

The present invention is made in view of the above-mentioned issues, and it is an object of the present invention to provide a driver in which an electric motor is controlled in response to a change in situation that affects a moving speed of a piston from a bottom dead point to a top dead point and a stop position. It is another object of the present invention to indirectly detect changes in these statuses by using rotation angle detection means of an electric motor, and to utilize them for improvement of control and operability.

Means for Solving the Problem

According to one aspect of the present invention, there is provided a driver comprising: a wheel rotationally driven by an electric motor; a plurality of pins provided to the wheel and arranged along a circumferential direction of the wheel; a piston reciprocably housed in a cylinder; a driver blade integrally reciprocating with the piston; a plurality of racks provided to the driver blade along an axial direction of the driver blade; and a controller configured to control a drive of the electric motor, wherein when the wheel is rotationally driven, the pins and the racks are sequentially engaged with each other so as to push up the driver blade, when the piston moves from a bottom dead point side to a top dead point side in the cylinder, and when the pins are disengaged from the racks, the piston moves from the top dead point side to the bottom dead point side in the cylinder, and the driver blade moves down, the controller controls an output of an electric motor driving element provided on a power supply line for the electric motor in response to a change in situation that affects a moving speed of the piston from the top dead point side to the top dead point side.

Effects of the Invention

In the driver according to the present invention, an electric motor is controlled in response to a change in situation that affects a moving speed of a piston from a bottom dead point side to a top dead point side.

DESCRIPTION OF PREFERRED EMBODIMENTS

First Embodiment

Figure 1:
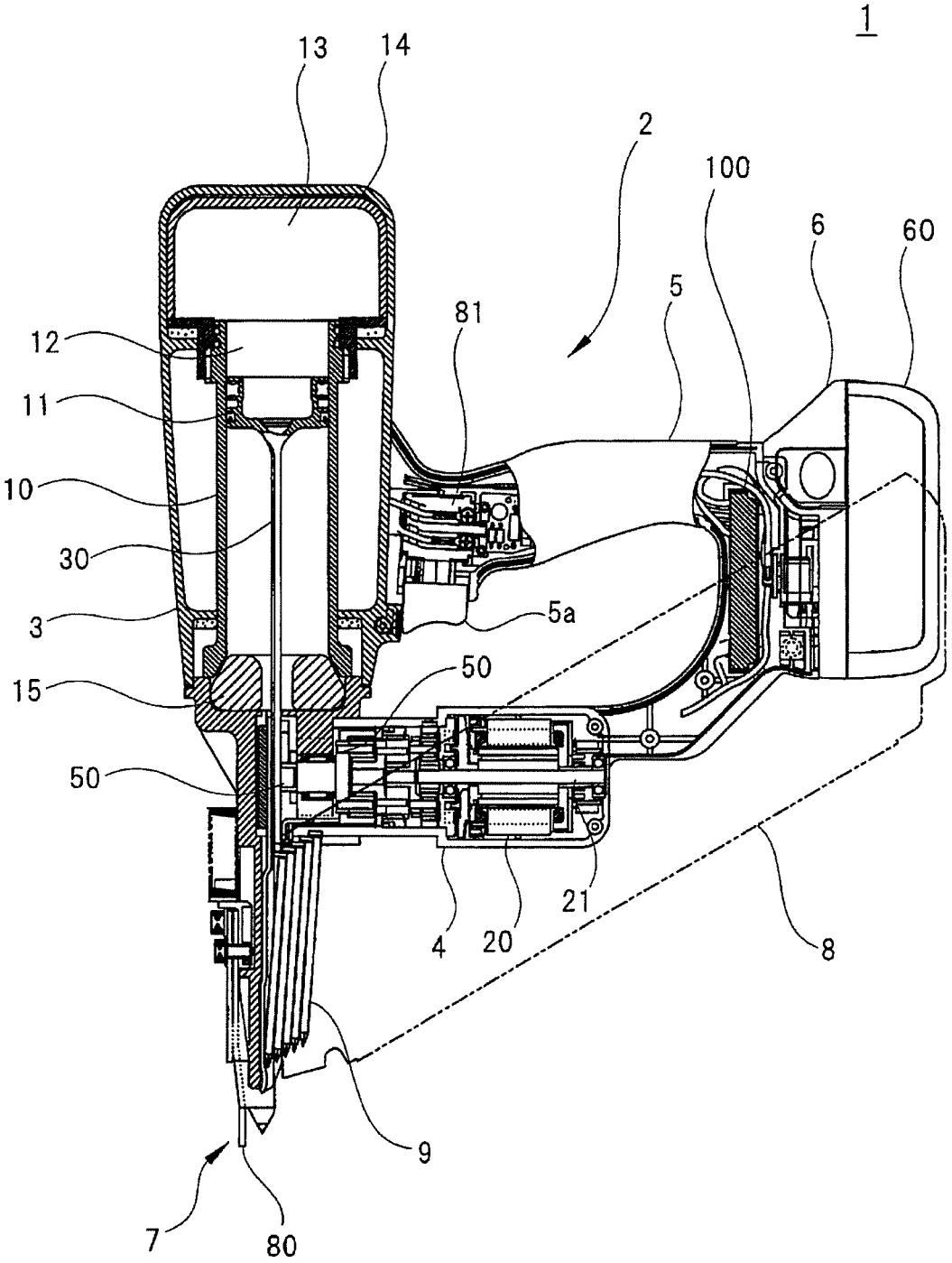
FIG. 1 is a cross-sectional view of a driver.

Hereinafter, one embodiment of the present invention will be described in detail with reference to the drawings. In the drawings based on the following description, components substantially the same as each other are denoted by the same reference numerals.

The driver 1 shown in FIG. 1 has a housing 2. The housing 2 includes a cylinder case 3, a motor case 4, and a handle 5, and a cylinder 10 is accommodated in the cylinder case 3, and an electric motor 20 is accommodated in the motor case 4. The motor case 4 and the handle 5 extend substantially parallel to each other from the cylinder case 3, and an end portion of the motor case 4 and an end portion of the handle 5 are connected to each other via a connection portion 6. The housing 2 has two housing halves molded from synthetic resin such as nylon or polycarbonate, and the housing 2 is assembled by butting these two housing halves to each other.

A piston 11 is reciprocably accommodated in the cylinder 10. Inside the cylinder 10, the piston 11 reciprocates between the top dead point and the bottom dead point along the axial direction of the cylinder 10. In other words, the piston 11 moves from the top dead point side to the bottom dead point side in the cylinder 10, and moves from the bottom dead point side to the top dead point side. In the cylinder 10, a piston chamber 12 whose volume increases and decreases with reciprocation of the piston 11 is defined by an inner circumferential surface of the cylinder 10 and an upper surface of the piston 11.

On the other hand, a driver blade 30 is connected to a lower surface of the piston 11, the driver blade 30 is integral with the piston 11, and the driver blade 30 reciprocates with the piston 11. Specifically, a nose portion 7 is provided to the tip of the cylinder case 3, and an injection passage 7*a* (FIG. 2) is provided inside the nose portion 7. The driver blade 30 reciprocates in the injection passage 7*a* with the reciprocation of the piston 11. In the following description, the reciprocating direction of the piston 11 and the driver blade 30 is defined as a vertical direction in FIG. 1. That is, the vertical direction in FIG. 1 is defined as its vertical direction.

A magazine 8 in which a number of stoppers 9 are housed is mounted on the housing 2. The stoppers 9 accommodated in the magazine 8 are supplied one by one to the injection passage 7*a* by a supply mechanism provided in the magazine 8. The driver blade 30 is configured to hit the head of each stopper 9 which is sequentially supplied to the injection passage 7*a*. When the head portion of the stopper 9 is hit by the driver blade 30, it passes through the injection passage 7*a*, and is driven out from an injection port which is an outlet of the injection passage 7*a*, and is driven into an object such as wood or gypsum board.

Figure 2:
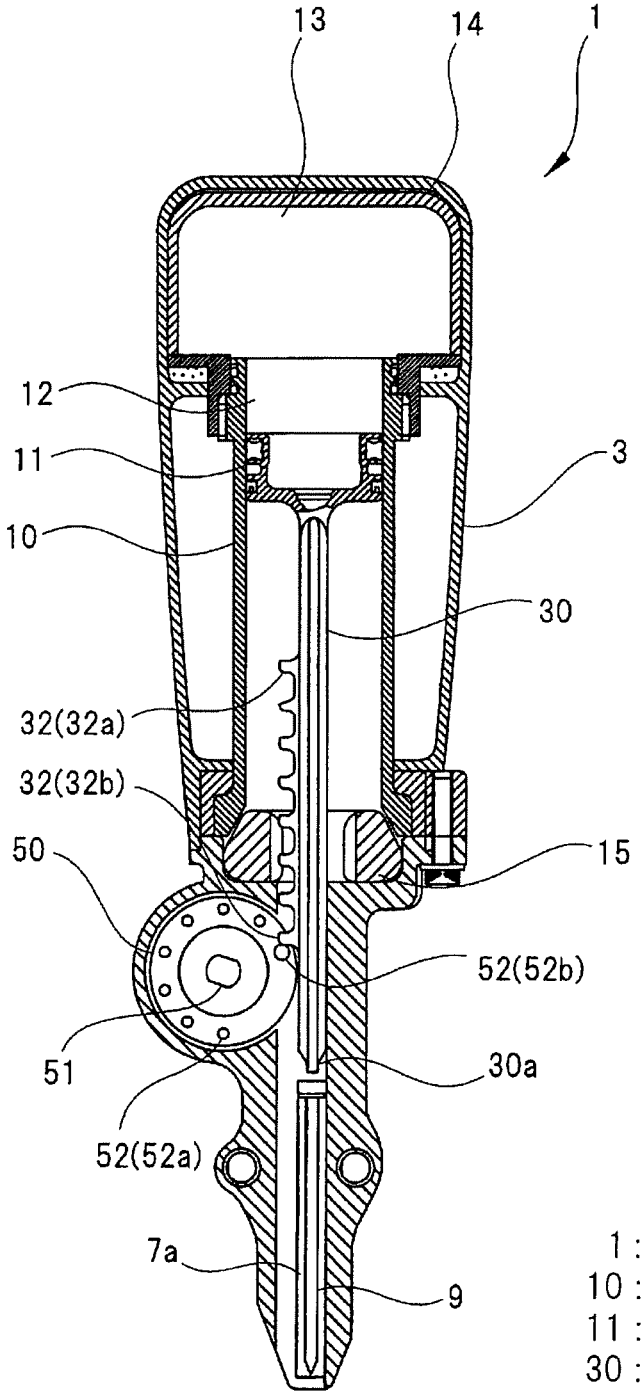
FIG. 2 is another cross-sectional view of the driver.

Note that the piston 11 shown in FIGS. 1 and 2 is in the top dead point, and the tip 30*a* of the driver blade 30 is in the maximum position. In other words, the "maximum position" is defined as the position of the tip 30*a* of the driver blade 30 with the piston 11 located at the top dead point. When the piston 11 shown in FIGS. 1 and 2 moves to the bottom dead point, the driver blade 30 moves down, and the tip 30*a* of the driver blade 30 moves to the lower limit position. In other words, the "lower limit position" is defined as the position of the tip 30*a* of the driver blade 30 when the piston 11 is at the bottom dead point. In the following description, the tip 30*a* of the driver blade 30 may be referred to as a "blade tip 30*a*". The position of the blade tip 30*a* may be referred to as a "blade tip position".

A damper 15 made of rubber or urethane is provided at the bottom of the cylinder 10. When the piston 11 reaches the bottom dead point, the damper 15 receives the piston 11, and avoids collision between the piston 11 and the cylinder 10. A driver blade 30 extends downwardly from the piston 11 so as to pass through the damper 15, and projects from the cylinder 10 through a through hole provided to the bottom of the cylinder 10.

As shown in FIG. 2, a wheel 50 is provided in the vicinity of the driver blade 30. The wheel 50 is fixed to a drive shaft 51 which is rotatably supported, and a plurality of pins 52 are attached to the wheel 50 at intervals along the circumferential direction of the wheel 50. On the other hand, the driver blade 30 is provided with a plurality of racks 32 arranged along its axial direction.

Referring to FIG. 1 again, an electric motor 20 serving as a drive source of the wheel 50 is housed in the motor case 4, and an output shaft 21 of the electric motor 20 is connected to a drive shaft 51 of the wheel 50 via a planetary gear type reduction mechanism. The electric motor 20 is operated by electric power supplied from a battery 60 mounted on the coupling portion 6 of the housing 2. That is, the battery 60 is a power source of the electric motor 20. In the present embodiment, the battery 60 is a secondary battery including a plurality of battery cells (lithium ion batteries). However, the battery cell may be replaced with a nickel-metal-hydride battery, a lithium-ion polymer battery, a nickel-cadmium battery, or the like.

Figure 3:
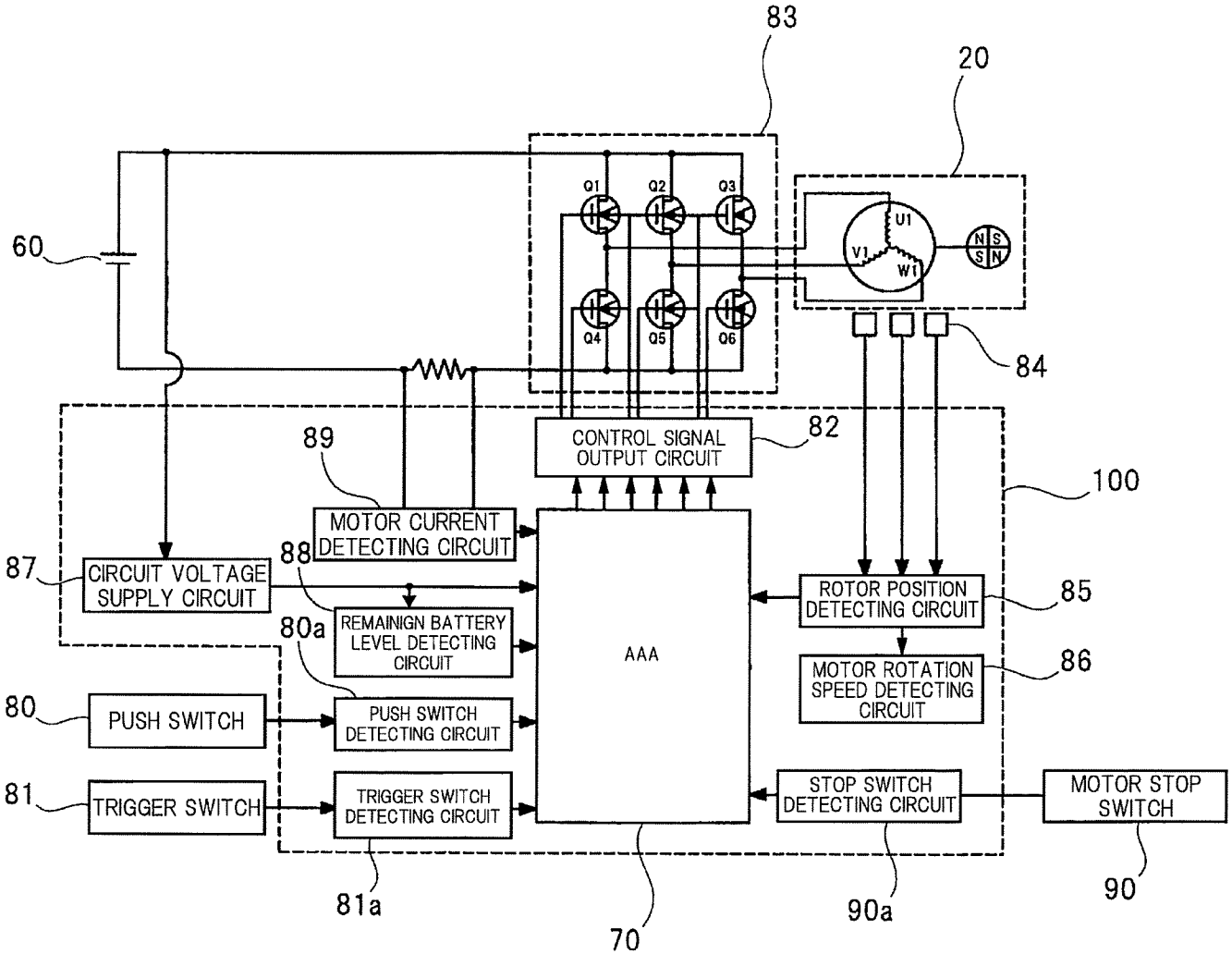
FIG. 3 is a block diagram showing a control mechanism of the driver.

A control board 100 is housed in the coupling portion 6. As shown in FIG. 3, a controller 70 as a control section is mounted on the control board 100. The controller 70 is a microcomputer composed of CPU, ROM, RAM, and the like, and configured to control the electric motor 20 on the basis of Pulse Width Modulation method. Specifically, the electric motor 20 is a brushless motor, and the controller 70 adjusts the ratio between the ON time and the OFF time of switching elements Q1 to Q6 provided on a power supply line for the electric motor 20 as a electric motor driving element for driving the electric motor, that is, "duty ratio". The control of the electric motor 20 will be described in detail later. The electric motor driving element is preferably a switching element such as an FET or a IGBT for performing switching control.

As shown in FIG. 1, a pressure accumulating chamber 14 forming a pressure accumulating chamber 13 is provided above the cylinder 10, and the pressure accumulating chamber 13 communicates with the piston chamber 12. The piston chamber 12 and the pressure accumulating chamber 13 are filled with a compressible fluid ("compressed air" in the present embodiment) in advance. When the piston 11 at the bottom dead point is moved to the top dead point, the electric motor 20 is operated under the control of the controller 70 (FIG. 3) to rotate the wheel 50. The wheel 50 rotates counterclockwise in FIG. 2.

By rotating the wheel 50, the pin 52*a* is engaged with the rack 32*a*. Then, with the rotation of the wheel 50, the pins 52 on the downstream side of the pin 52*a* in the rotation direction of the wheel 50 and the racks 32 on the lower side of the rack 32*a* in the moving direction of the driver blade 30 are sequentially engaged with each other, the driver blade 30 is gradually pushed up, and the piston 11 moves from the bottom dead point side to the top dead point side. That is, the driver blade 30 and the piston 11 move up. Then, when the wheel 50 is rotated until the pin 52*b* on the most downstream side in the rotation direction is engaged with the rack 32*b* on the most lower side in the moving direction, the driver blade 30 is pushed up to the uppermost position, and the piston 11 reaches the top dead point. In other words, when the wheel 50 is rotated until the pin 52*b* farthest from the pin 52*a* in the direction of rotation of the wheel 50 is engaged with the rack 32*b* farthest from the rack 32*a* in the direction of movement of the driver blade 30, the driver blade 30 is pushed up to the uppermost position and the piston 11 reaches the top dead point. When the driver blade 30 is pushed up to the uppermost position, the blade tip 30*a* reaches the maximum position.

In the process of moving (upward) the piston 11 as described above, air in the piston chamber 12 is fed into the pressure accumulating chamber 13 and compressed. Then, when the engagement between the pin 52*b* and the rack 32*b* is released, the piston 11 is moved from the top dead point to the bottom dead point by the pressure of compressed air in the piston chamber 12 and the pressure accumulating chamber 13, and the driver blade 30 is moved down.

In this manner, of the pins 52 and the racks 32, the pin 52*a* and the rack 32*a* is engaged with each other first when the piston 11 at the bottom dead point is moved toward the top dead point side. On the other hand, of the pins 52 and the racks 32, the pin 52*b* and the rack 32*b* is finally engaged with each other when the piston 11 at the bottom dead point is moved toward the top dead point. Therefore, in the following description, the pin 52*b* may be referred to as the "last pin 52*b*", and the rack 32*b* may be referred to as the "last rack 32*b*". In the present embodiment, the last pin 52*b* is slightly thicker than the other pins 52, including pin 52*a*. The distance (separation angle) between the pin 52*a* and the last pin 52*b* along the rotation direction of the wheel 50 is 60 degrees, and the distance (separation angle) between the other pins 52 is 30 degrees.

Referring to FIG. 1 again, the nose portion 7 is provided with a push switch 80. The push switch 80 is held so as to be movable in the vertical direction, and it is always urged downward by a coil spring. When the push switch 80 is pressed against the driven member, and it moves upward against the urging force of the coil spring, a signal (push switch signal) is output from the push switch detecting circuit 80*a* (FIG. 3). A trigger switch 81 is built in the handle 5. When the trigger 5*a* provided on the handle 5 is operated, the trigger switch 81 is operated, and when the trigger switch 81 is operated, a signal (trigger switch signal) is output from the trigger switch detecting circuit 81*a* (FIG. 3).

As shown in FIG. 3, the push switch detecting circuit 80*a* and the trigger switch detecting circuit 81*a* are mounted on the control board 100 mounted with the controller 70, and the push switch signal output from the push switch detecting circuit 80*a* and the trigger switch signal output from the trigger switch detecting circuit 81*a* are input to the controller 70. When two signals are input to the controller 70, the controller 70 turns on/off the switching elements Q1 to Q6 of the inverter circuit 83 via the control signal output circuit 82 to supply motor current to the electric motor 20. As a result, the wheel 50 shown in FIG. 2 is rotationally driven, the driver blade 30 is pushed up, and the piston 11 moves from the bottom dead point side to the top dead point side. After that, the piston 11 moves from the top dead point side to the bottom dead point side, and the driver blade 30 moves downs. That is, the piston 11 reciprocates between the bottom dead point and the top dead point, and as a result, the stopper 9 is hit by the driver blade 30. In other words, the driving operation is performed once. The inverter circuit 83 shown in FIG. 3 is a three-phase full-bridge inverter circuit in which switching devices Q1 to Q3 are high-side switching elements, and switching elements Q4 to Q6 are low-side switching elements.

As shown in FIG. 3, a rotor position detecting circuit 85 for detecting the position of the rotor of the electric motor 20 based on a signal output from the Hall element 84, which is a magnetic sensor, and a motor rotation number detecting circuit 86 for detecting the rotation number of the rotor of the electric motor 20 based on the detection of the rotor position detecting circuit 85 are mounted on the control board 100. Furthermore, the control board 100 is mounted with a low-side switching elements 87 for supplying electric power necessary for the controller 70, and a remaining battery level detecting circuit 88 for detecting the remaining battery level of the battery 60 based on electric power (voltage) supplied to the controller 70 via the circuit voltage supply circuit 87. In addition, a motor current detecting circuit 89 for detecting a motor current supplied from the battery 60 to the electric motor 20 and a stop switch detecting circuit 90*a* for outputting a signal (motor stop signal) when the motor stop switch 90 is operated are mounted on the control board 100. The motor current detecting circuit 89 is connected to both ends of the current detection resistor, and configured to detect the value of current to be supplied to the electric motor 20. The motor stop switch 90 is operated when the rotation angle of the wheel 50 (FIG. 2) reaches a predetermined angle. The stop switch signal output from the stop switch detecting circuit 90*a* is input to the controller 70 in the same manner as the signal output from the other detecting circuits. The controller 70 controls the inverter circuit 83 based on the signals output from the detecting circuits. Specifically, each of the switching devices Q1 to Q6 of the inverter circuit 83 is turned ON/OFF, or the ratio between the ON time and the OFF time of each of the switching elements Q1 to Q6 is adjusted. That is, the electric motor 20 is subjected to PWM control. In the following description, the switching devices Q1 to Q6 are sometimes collectively referred to as "switching elements". In the following description, unless otherwise specified, the "duty ratio" means the ratio between the ON time and the OFF time of the switching elements Q1 to Q6.

When the driving operation is executed once, the controller executes predetermined stop control in either the case of single-shot driving or continuous-shot driving. Specifically, the controller 70 continues to operate the electric motor 20 until the blade tip 30*a* (FIG. 2) moves to the standby position, and then stops the electric motor 20.

When the driving operation is completed, the piston 11 is in the bottom dead point, and as a result, the blade tip 30*a* is in the lower limit position. After the driving operation is performed, the controller 70 continues to operate the electric motor 20 until the blade tip 30*a* moves up to the standby position set between the lower limit position and the maximum position, and then stops the electric motor 20. As a result, the piston 11 moves to (moves up to) an intermediate position between the bottom dead point and the top dead point. In other words, the "intermediate position" of the piston 11 is defined as the position of the piston 11 with the blade tip 30*a* occupies the standby position.

The standby position is set between the lower limit position and the head of the stopper 9 to be supplied to the injection passage 7*a* in the next driving operation. That is, the standby position is a position higher than the lower limit position and lower than the head of the stopper 9 supplied to the injection passage 7*a* in the next driving operation. In other words, the standby position is higher than the lower limit position and lower than the head of one stopper 9 positioned at the head of stoppers 9 held in the magazine 8.

A significance of the above stop control is as follows. That is, when the driving operation is performed next, it is enough to move the blade tip 30*a* from the standby position to the maximum position. On the other hand, when the blade tip 30*a* is at the lower limit position, the blade tip 30*a* must be moved from the lower limit position to the maximum position when the next driving operation is performed. That is, if the blade tip 30*a* is moved to the standby position in advance by executing the stop control, the moving distance (stroke) of the driver blade 30 for the next driving operation is shortened, and the responsiveness is improved. Furthermore, in the present embodiment, the standby position is set to a position lower than the head of the stopper 9 at the head. Therefore, the supply of the stopper 9 to the injection passage 7*a* is regulated by the driver blade 30.

The above is the basic operation of the driver 1 according to the present embodiment. That is, when the predetermined condition is satisfied, the electric motor 20 is operated under the control of the controller 70 to rotate the wheel 50. As a result, the pins 52 provided on the wheel 50 and the racks 32 provided on the driver blade 30 are sequentially engaged with each other, and the driver blade 30 is pushed up. At the same time, the piston 11 moves in the cylinder 10 from the bottom dead point side toward the top dead point side. After that, when the piston 11 reaches the top dead point, and the last pin 52*b* and the final rack 32*b* are disengaged from each other, the piston 11 is moved from the top dead point side toward the bottom dead point side by the air pressure (gas spring), the driver blade 30 moves down, and the stopper 9 is driven out. After that, the above operation is repeated as long as the predetermined condition is satisfied, and when the predetermined condition is not satisfied, the above operation is stopped. When end the driving operation, the blade tip 30*a* is moved to the standby position to prepare for the next driving operation.

The controller 70 shown in FIG. 3 has at least a first start mode and a second start mode as a control mode of the electric motor 20. The first start mode and the second start mode are control modes relating to the start control of the electric motor 20.

When the first start mode is selected, the controller 70 sets the duty ratio of the switching elements Q1 to Q6 at the time of starting the electric motor 20 to a first value. On the other hand, when the second starting mode is selected, the controller 70 sets the duty ratio of the switching elements Q1 to Q6 at the time of starting the electric motor 20 to a second value higher than the first value. The controller 70 selectively switches between the first start mode and the second start mode in response to a change in situation that affects the moving speed of the piston 11 toward the top dead point.

A situation affecting the moving speed of the piston 11 to the top dead point side includes, for example, a remaining battery level of the battery 60, a change in pressure in the piston chamber 12 or the pressure accumulation chamber 13, and a change in ambient temperature. In the present embodiment, one of the first start mode and the second start mode is selected in response to the remaining battery level of the battery 60, and the electric motor 20 is started in accordance with the selected start mode. More specifically, the first start mode is selected when the remaining battery level is 40% or more, and the second start mode is selected when the remaining battery level is 40% or less.

Figure 4:
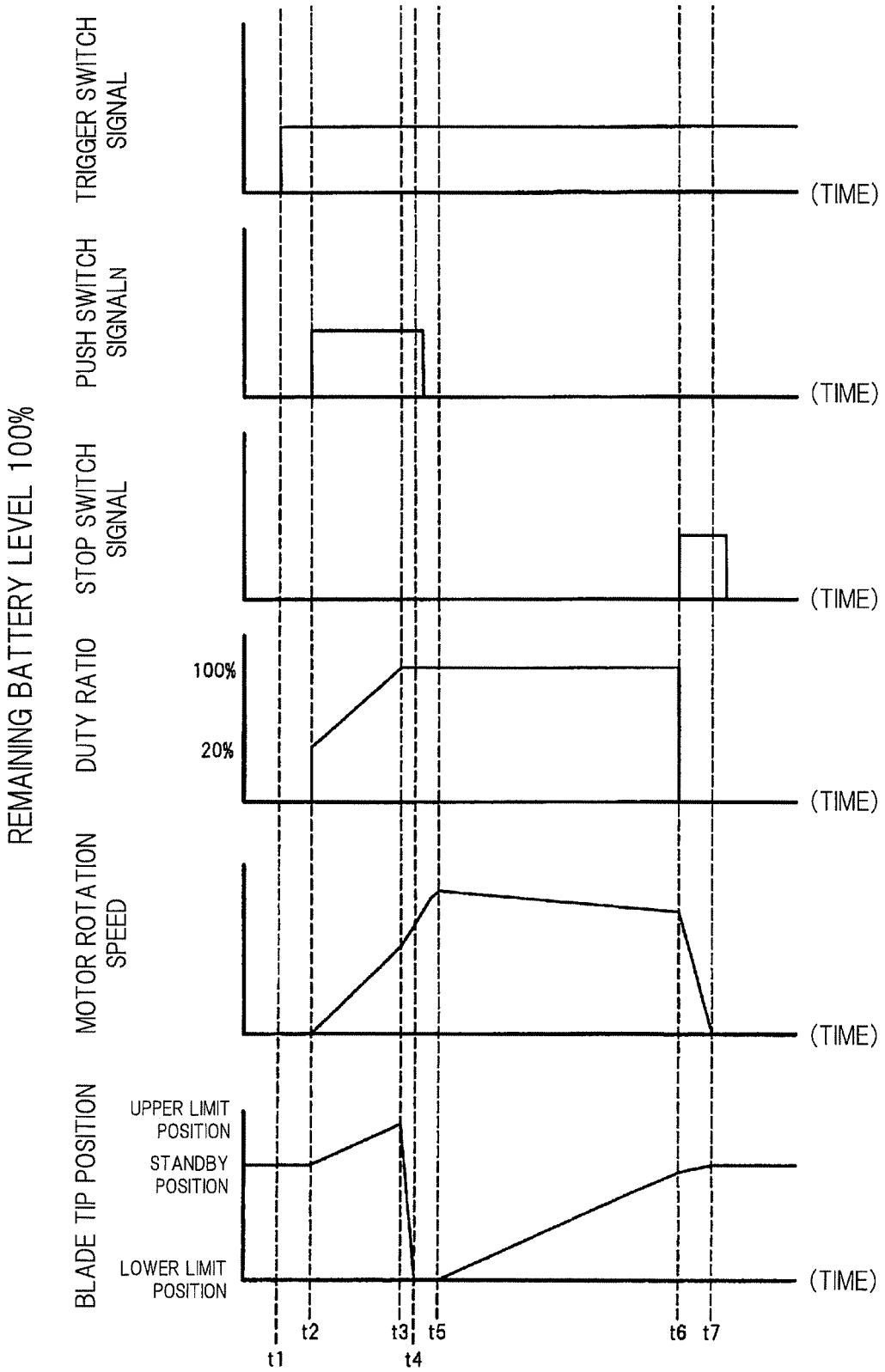
FIG. 4 is a time chart relating to a first start mode.

FIG. 4 shows the relationship among the motor rotation speed, the blade tip position, and the duty ratio when the remaining battery level at the time of starting the electric motor 20 is 100%. In other words, the relationship among the motor rotation speed, the blade tip position, and the duty ratio is shown under the condition that the remaining battery level is larger than a predetermined reference value (40%) when the trigger switch signal and the push switch signal are input to the controller 70 shown in FIG. 3.

When the trigger switch 81 shown in FIG. 1 is operated, and the push switch 80 is pushed, the driving operation is started. Note that the stop control is executed at the end of the driving operation. Therefore, at the start of the driving operation, the piston 11 is in the intermediate position, and the blade tip 30*a* is in the standby position.

As shown in FIG. 4, when the trigger switch 81 is operated, a trigger switch signal is output at t1. Next, when the push switch 80 is pushed in, a push switch signal is output at t2. At this time, if the remaining battery level exceeds the reference value, the controller 70 starts the electric motor 20 in the first start mode. Specifically, the controller 70 sets the duty ratio to the first value of 20%. In other words, the controller 70 starts the electric motor 20 at a duty ratio of 20% (t2). After that, the controller 70 gradually increases the duty ratio to 100%. The revolution number of the motor gradually increases with an increase in duty ratio (t2 to t3).

When the electric motor 20 is started, the wheel 50 rotates, the driver blade 30 is pushed up, and the piston 11 moves up from the intermediate position toward the top dead point. As the piston 11 moves up, the pressure in the piston chamber 12 and the pressure accumulating chamber 13 increases. At the same time, the blade tip 30*a* moves up from the standby position toward the maximum position (t2 to t3).

After that, the piston 11 reaches the top dead point, and the blade tip 30*a* reaches the maximum position (t3). After that, when the last pin 52*b* is disengaged from the final rack 32*b*, the piston 11 moves from the top dead point toward the bottom dead point, and the driver blade 30 moves down. When the last pin 52*b* and the final rack 32*b* are disengaged from each other, since the load of the electric motor 20 is lowered, the revolution number of the motor is increased from t3 to t4.

When the piston 11 reaches the bottom dead point as described above, the controller 70 executes the stop control. Specifically, the controller 70 continues to operate the electric motor 20 even after the last pin 52*b* and the final rack 32*b* are disengaged from each other. Therefore, the wheel 50 continues to rotate (t4-t5), and the pin 52*a* and the rack 32*a* are re-engaged with each other (t5). Between the disengagement of the last pin 52*b* and the final rack 32*b* and the re-engagement of the pin 52*a* and the rack 32*a* (t3 to t5), the electric motor 20 is driven at substantially no load, and the wheel 50 idles.

After that, when the pin 52*a* is re-engaged with the rack 32*a*, and the driver blade 30 starts to be pushed up, the pressure in the cylinder 10 gradually increases as the piston 11 moves up. As a result, the load of the electric motor 20 gradually increases, so that the revolution number of the motor gradually decreases from t5 to t6.

After that, when the blade tip 30*a* moves up to a predetermined position set slightly below the standby position, the motor stop switch 90 is operated, and a stop switch signal is output from the stop switch detecting circuit 90*a* in step t6. When the stop switch signal is input to the controller 70, the controller 70 stops the electric motor 20. At this time, the controller 70 does not stop the supply of the motor current to the electric motor 20, but applies the electric brake to the electric motor 20 to positively stop the electric motor 20. Specifically, the controller 70 outputs a brake signal to the control signal output circuit 82. When the brake signal is input to the control signal output circuit 82, the control signal output circuit 82 turns on the low-side switching elements Q4 to Q6 of the inverter circuit 83. As a result, the revolution number of the motor rapidly decreases, and the electric motor 20 stops in a short time t7. In this manner, the predetermined position is set in advance in consideration of the time required from the output of the stop switch signal to the stop of the electric motor 20.

Figure 5:
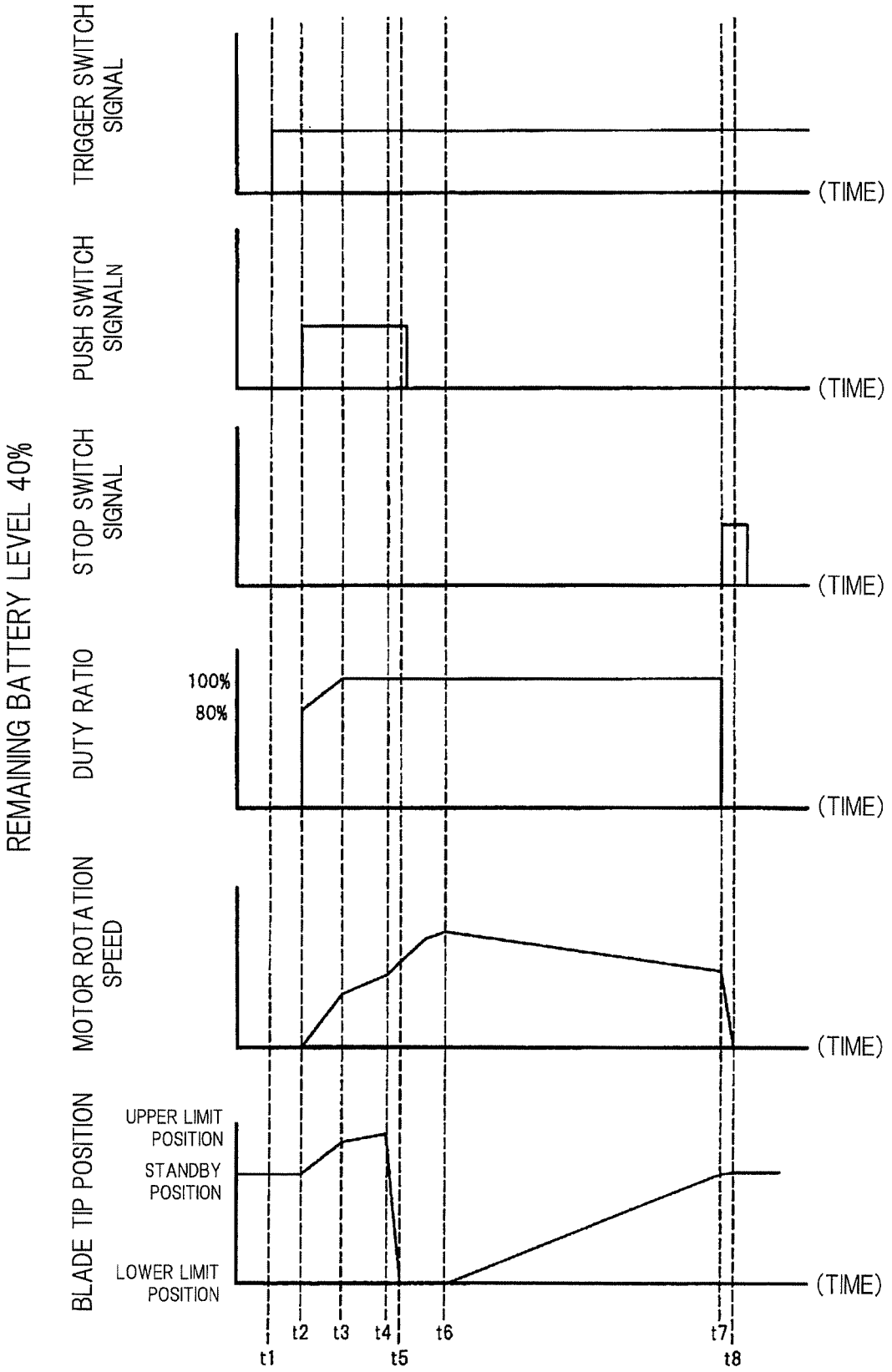
FIG. 5 is a time chart relating to a second start mode.

FIG. 5 shows the relationship among the motor rotation speed, the blade tip position, and the duty ratio when the remaining battery level at the time of starting the electric motor 20 is less than 40%. In other words, the relationship among the motor rotation speed, the blade tip position, and the duty ratio is shown under the condition that the remaining battery level is smaller than a predetermined reference value (40%) when the trigger switch signal and the push switch signal are input to the controller 70 shown in FIG. 3.

When the trigger switch signal and the push switch signal are input under the condition that the remaining battery level is lower than the reference value, the controller 70 starts the electric motor 20 in the second start mode. Specifically, the controller 70 sets the duty ratio to the second value of 80%. In other words, the controller 70 starts the electric motor 20 at a duty ratio of 80% (t2). Subsequent changes in motor speed and blade tip position as well as control of the electric motor 20 are substantially the same as those of the first start mode.

That is, when the remaining battery level is lower than the reference value, the electric motor 20 is started at a duty ratio higher than a duty ratio defined under the condition that the remaining battery level is higher than the reference value. As a result, a decrease in moving speed of the piston 11 due to a decrease in remaining battery level is suppressed. That is, the time required from the start of the electric motor 20 until the piston 11 reaches the top dead point is kept certain or substantially constant regardless of the remaining battery level. In other words, the time required from the start of the electric motor 20 until the blade tip 30*a* reaches the standby position or the maximum position is kept certain or substantially constant regardless of the remaining battery level. Therefore, the extension of the driving time and the deterioration of the continuous shot performance due to the decrease of the remaining battery level are prevented.

Note that the duty ratio at the time of starting the electric motor 20 is less than 100% at the time of selecting the first start mode and at the time of selecting the second start mode. That is, in any starting mode, a so-called "software start" is performed to prevent excessive motor current from being supplied to the electric motor 20. However, the duty ratios in the first start mode and the second start mode may be set to values different from the values described above. Furthermore, a reference in remaining battery level for switching the control mode is not limited to 40%.

Second Embodiment

Another embodiment of the present invention will be described with reference to the drawings. However, the basic configuration of the driver according to the present embodiment is the same as that of the driver 1 according to the first embodiment. Therefore, only the difference from the driver 1 according to the first embodiment will be described below, and the same components as those of the driver 1 according to the first embodiment are denoted by the same reference numerals.

The controller 70 in the present embodiment has at least a first stop mode and a second stop mode as the control mode of the electric motor 20. The first stop mode and the second stop mode are control modes relating to stop control of the electric motor 20.

When the first stop mode is selected, the controller 70 stops the electric motor 20 after a first time (T1) has elapsed after the piston 11 moving from the bottom dead point side to the top dead point side passes through a predetermined position set between the bottom dead point and the intermediate position. On the other hand, when the second stop mode is selected, the controller 70 stops the electric motor 20 after a second time (T2) longer than the first time (T1) has elapsed after the piston 11 moving from the bottom dead point side to the top dead point side passes through the predetermined position.

The controller 70 selectively switches between the first stop mode and the second stop mode in response to a change in situation that affects the moving speed of the piston 11 toward the top dead point. In the present embodiment, one of the first stop mode and the second stop mode is selected in response to a change in remaining battery level of the battery 60. More specifically, the first stop mode is selected when the remaining battery level is 40% or more, and the second stop mode is selected when the remaining battery level is 40% or less.

Figure 6:
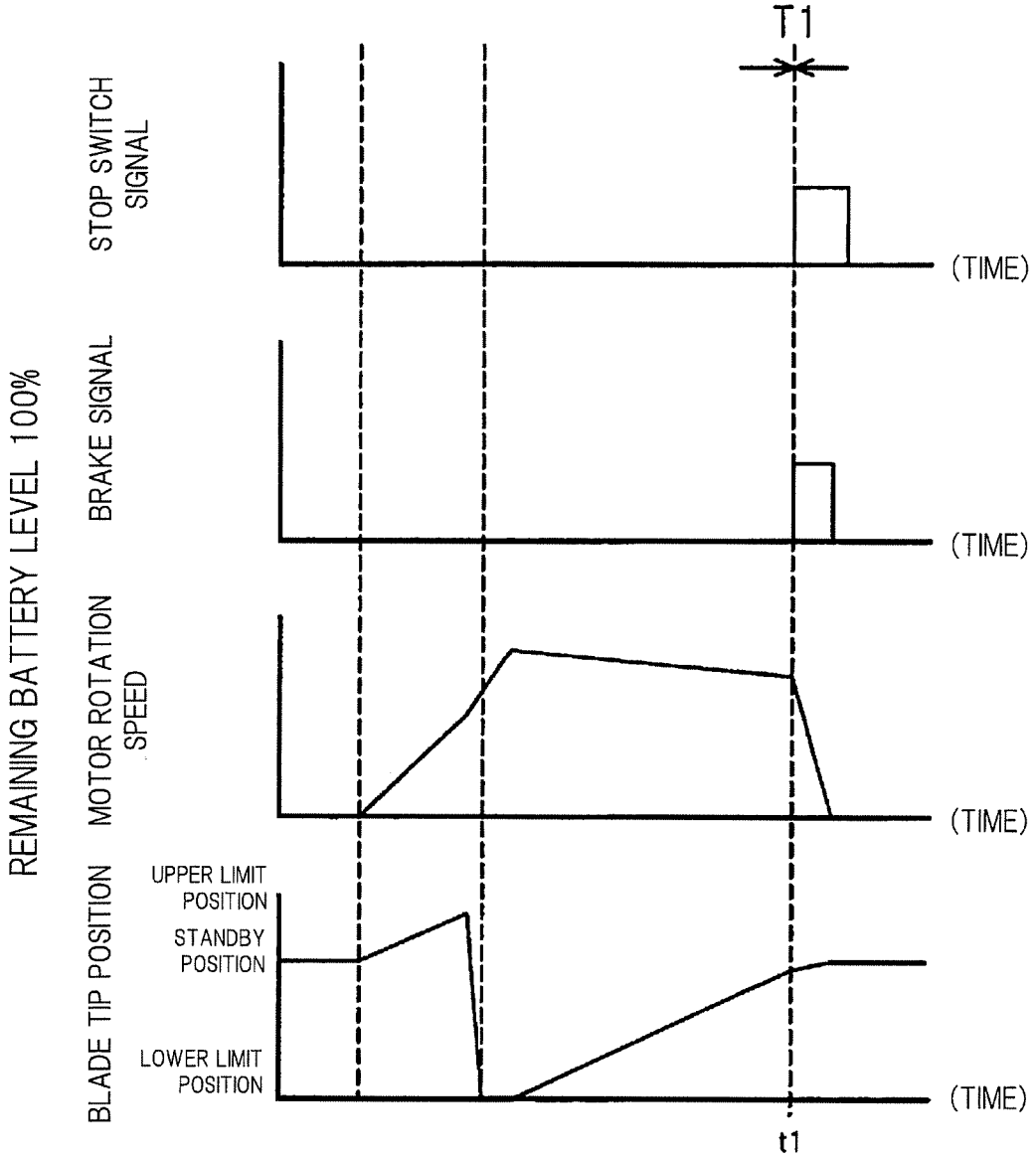
FIG. 6 is a time chart relating to a first stop mode.

FIG. 6 shows the relationship among the stop switch signal, the brake signal, the motor rotation speed, and the blade tip position under the condition that the remaining battery level is 100% at the time of execution of the stop control. That is, with the first stop mode selected, the relationship among the stop switch signal, the brake signal, the motor rotation speed, and the blade tip position is shown in FIG. 6.

As shown in FIG. 6, when the blade tip 30*a* passes through the predetermined position, the motor stop switch 90 is operated, and a stop switch signal is output (t1). When the stop switch signal is input to the controller 70, the controller 70 outputs a brake signal immediately to the control signal output circuit 82 and applies an electrical brake to the motor 20 (t1). Note that the piston 11 moves integrally with the driver blade 30. Therefore, when the blade tip 30*a* moving from the lower limit position side to the maximum position side passes through the predetermined position, the piston 11 moving from the bottom dead point side to the top dead point side also passes through the predetermined position in the cylinder 10. Therefore, the controller 70 can recognize that the piston 11 has passed through the predetermined position by inputting the stop switch signal. As described above, in the first stop mode, the electric motor 20 is stopped after the first time T1 has elapsed after the piston 11 moving from the bottom dead point side to the top dead point side passes through the predetermined position. The first time T1 in the present embodiment is substantially zero second.

Figure 7:
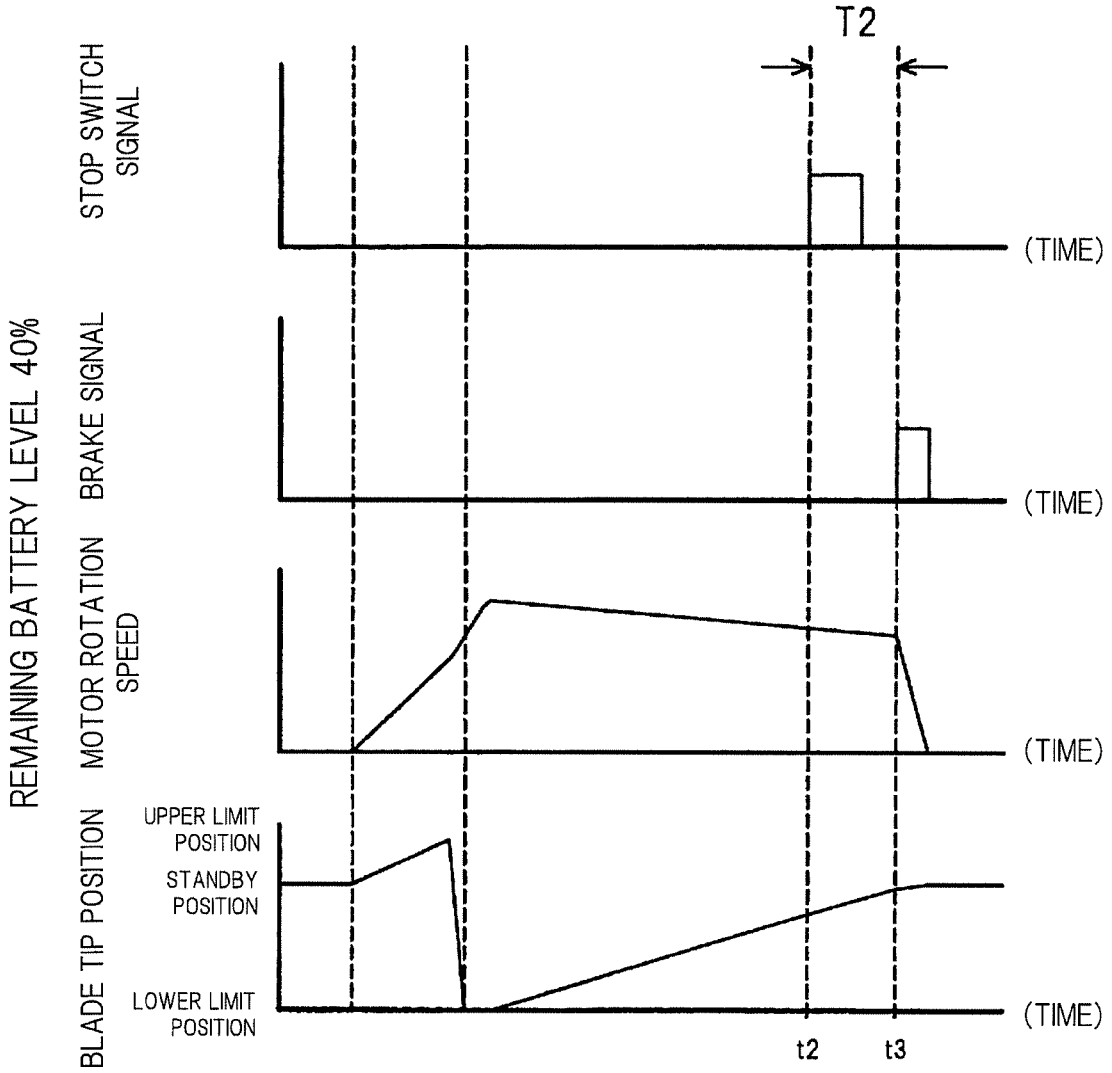
FIG. 7 is a time chart relating to a second stop mode.

On the other hand, FIG. 7 shows the relationship between the stop switch signal, the brake signal, the motor rotation speed, and the blade tip position under the condition that the remaining battery level is 40% at the time of execution of the stop control. That is, with the second stop mode selected, the relationship among the stop switch signal, the brake signal, the motor rotation speed, and the blade tip position is shown in FIG. 7.

As shown in FIG. 7, when the blade tip 30*a* passes through the predetermined position, the motor stop switch 90 is operated, and a stop switch signal is output at time t2. When the stop switch signal is input to the controller 70, the controller 70 outputs a brake signal to the control signal output circuit 82 after the second time (T2) has elapsed since the stop switch signal was input, and applies an electric brake to the electric motor 20 (t3). That is, in the second stop mode, the electric motor 20 is stopped after the second time T2 elapses after the blade tip 30*a* moving from the lower limit position side to the maximum position side passes through the predetermined position. In other words, the electric motor 20 is stopped after the second time T2 elapses after the piston 11 moving from the bottom dead point side to the top dead point side passes through the predetermined position. The second time (T2) in the present embodiment is longer than the first time (T1).

Specifically, the first time T1 is a time required to allow the blade tip 30*a* to reach the standby position after passing through the predetermined position under the condition that the remaining battery level is 100%. On the other hand, the second time T2 is a time required to allow the blade tip 30*a* to reach the standby position after passing through the predetermined position under the condition that the remaining battery level is 40%. Since the moving speed of the piston 11 decreases when the remaining battery level decreases, it takes more time for the blade tip 30*a* to reach the standby position after passing through the predetermined position. In other words, more time is required from when the piston 11 passes through the predetermined position to when it reaches the intermediate position. Therefore, in the second stop mode, after the blade tip 30*a* passes through the predetermined position, the electric motor 20 is stopped after the elapse of the second time (T2) longer than the first time (T1). As a result, the blade tip 30*a* can always be moved to and stopped at the same stop position, in the present embodiment, the standby position, regardless of the remaining battery level. In other words, regardless of the remaining battery level, the piston 11 can always be moved to the same stop position (intermediate position in the present embodiment) and then stopped.

However, by making the second time (T2) longer, the stop position of the blade tip 30*a* in the second stop mode (the stop position of the piston 11) can be set to the maximum position side (the top dead point) closer than the stop position of the blade tip 30*a* in the first stop mode (the stop position of the piston 11). In other words, the standby position of the first stop mode can be made different from the standby position of the second stop mode. Furthermore, in other words, when the remaining battery level is small, the standby position may be shifted to the top dead point side. As a result, variation in time between the restart and the driving start of the electric motor 20 is suppressed.

Third Embodiment

Another embodiment of the present invention will be described with reference to the drawings. However, the basic configuration of the driver according to the present embodiment is the same as that of the driver 1 according to the first and second embodiments. Therefore, only differences from the driver 1 according to the first and second embodiments will be described below, and the same components as those of the driver 1 according to the first and second embodiments are denoted by the same reference numerals.

The controller 70 in the present embodiment has at least a first stop mode and a second stop mode as the control mode of the electric motor 20. The first stop mode and the second stop mode are control modes relating to stop control of the electric motor 20.

When the first stop mode is selected, the controller 70 stops the electric motor 20 after the piston 11 moving from the bottom dead point side to the top dead point side passes through the predetermined position set between the bottom dead point and the intermediate position, and after the electric motor 20 rotates by the first rotation amount. On the other hand, when the second stop mode is selected, the controller 70 stops the electric motor 20 after the piston 11 moving from the bottom dead point side to the top dead point side passes through the predetermined position, and after the electric motor 20 rotates by the second rotation amount larger than the first rotation amount.

The controller 70 switches between the first stop mode and the second stop mode in response to a change in situation that affects the moving speed of the piston 11 toward the top dead point side. In the present embodiment, one of the first stop mode and the second stop mode is selected in response to a change in remaining battery level of the battery 60. More specifically, the first stop mode is selected when the remaining battery level is 40% or more, and the second stop mode is selected when the remaining battery level is 40% or less.

In the present embodiment, in addition to the Hall element 84 and the rotor position detecting circuit 85 shown in FIG. 3, a motor rotation amount detecting circuit for outputting a counter signal based on the detection of the rotor position detecting circuit 85 is mounted on the control board 100. The controller 70 recognizes the rotation amount of the electric motor 20 by counting the counter signal output from the motor rotation amount detecting circuit. Note that the Hall element 84 in the present embodiment outputs a signal every time the electric motor 20 rotates by 30 degrees. Furthermore, the rotor position detecting circuit 85 outputs a signal each time a signal output from the Hall element 84 is input. Furthermore, the motor rotation amount detecting circuit outputs a counter signal every time a signal output from the rotor position detecting circuit 85 is input. That is, each time the electric motor 20 rotates 30 degrees, a counter signal is input to the controller 70. In other words, each time the electric motor 20 rotates 30 degrees, the counter signal is accumulated in the controller 70. The controller 70 recognizes the rotation amount of the electric motor 20 based on the integrated number of the counter signals.

When the first stop mode is selected, the controller 70 stops the electric motor 20 when the integrated number of counter signals reaches a predetermined number (first count number (N1)) after the piston 11 moving from the bottom dead point side to the top dead point side passes through the predetermined position set between the bottom dead point and the intermediate position. On the other hand, when the second stop mode is selected, the controller 70 stops the electric motor 20 when the integrated number of counter signals reaches a predetermined number (second count number (N2)) larger than the first count number (N1) after the piston 11 moving from the bottom dead point to the top dead point passes through the predetermined position.

As a result, the same operation and effect as those of the second embodiment can be obtained. That is, the blade tip 30*a* can be always moved to the same stop position and stopped regardless of the remaining battery level. However, by setting the second count number (N2) to a larger number, the stop position of the blade tip 30*a* in the second stop mode can be set to the maximum position side (top dead point side) of the stop position of the blade tip 30*a* in the first stop mode.

Fourth Embodiment

Another embodiment of the present invention will be described with reference to the drawing. However, the basic configuration of the driver according to the present embodiment is the same as that of the driver 1 according to the first to third embodiments. Therefore, only differences from the first embodiment and the like will be described below, and the same components as those of the driver 1 according to the first embodiment are denoted by the same reference numerals.

The controller 70 in the present embodiment includes at least a first stop detecting mode and a second stop detecting mode as the control mode of the electric motor 20. The first stop detecting mode and the second stop detecting mode are control modes capable of detecting a rotation state until the electric motor 20 stops.

As shown in FIG. 1, a piston 11 is reciprocably housed in a cylinder 10, and a piston chamber 12 is defined as a sealed space whose volume increases and decreases with the reciprocation of the piston 11. The piston chamber 12 is filled with compressed gas, preferably compressed air, inert gas, rare gas, dry air, or the like so that the piston 11 is put under atmospheric pressure or higher at the bottom dead point.

The controller 70 stops the supply of electric power to the electric motor 20 when the piston 11 moving from the bottom dead point side to the top dead point side passes through a predetermined reference position arbitrarily set between the bottom dead point and the top dead point, and the electric motor 20 stops after the supply of electric power is stopped and then rotates by a predetermined rotation amount by an inertial force. Here, the rotation amount due to the inertial force after the supply of electric power is stopped depends on the magnitude of pressure that the piston 11 receives in a direction of the bottom dead point by the compressed gas in the piston chamber 12. That is, when the pressure at the time of filling the piston chamber 12 with compressed air is assumed to be the reference pressure, the rotation amount due to the inertial force of the electric motor 20 decreases when the pressure is higher than the reference pressure, and when the pressure is lower than the reference pressure, the rotation amount due to the inertial force of the electric motor 20 increases. In other words, it is possible to estimate the pressure of the piston chamber 12 by detecting the rotation amount due to the inertial force of the electric motor 20.

Figure 8:
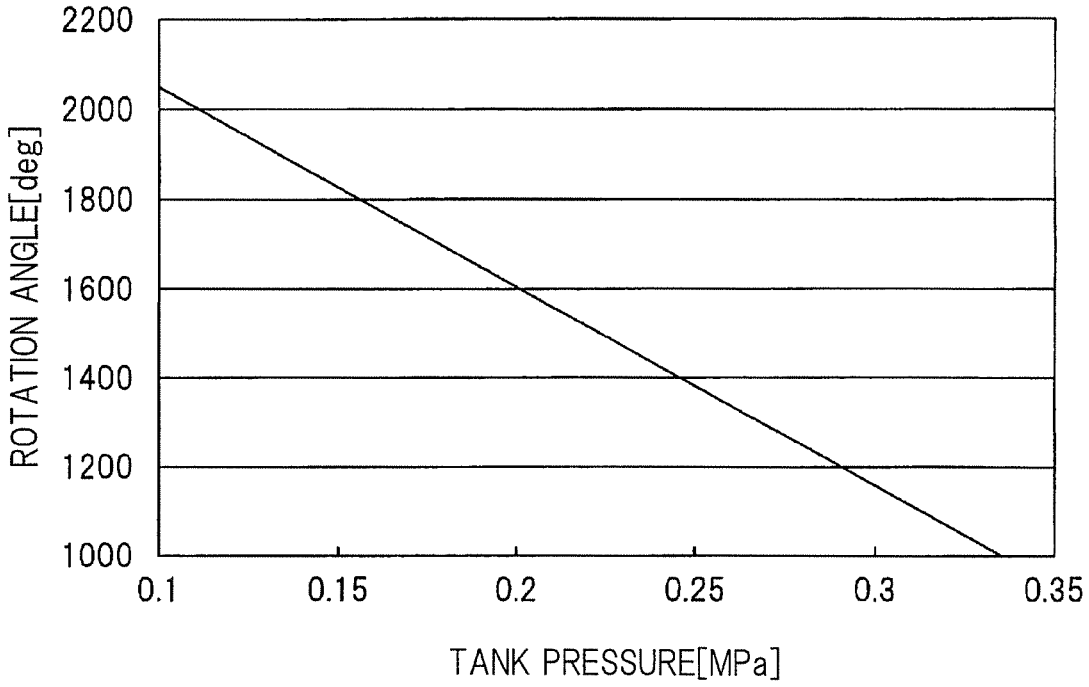
FIG. 8 is a characteristic diagram showing the relationship between a pressure in a piston chamber and a rotation angle of an electric motor.

FIG. 8 shows the relationship between the pressure of the piston chamber 12 and the rotation angle. FIG. 8 is a graph in one preferred embodiment of the present invention, and a specific value depends on the volume and pressure of the piston chamber 12, the area and pressure of the piston 11, and the magnitude of the moment of inertia of the rotating body such as gear, rotating together with the electric motor 20. As shown in FIG. 8, as the tank pressure (the piston chamber 12) increases, the rotation angle (the rotation amount due to the inertial force) attenuates.

Figure 9:
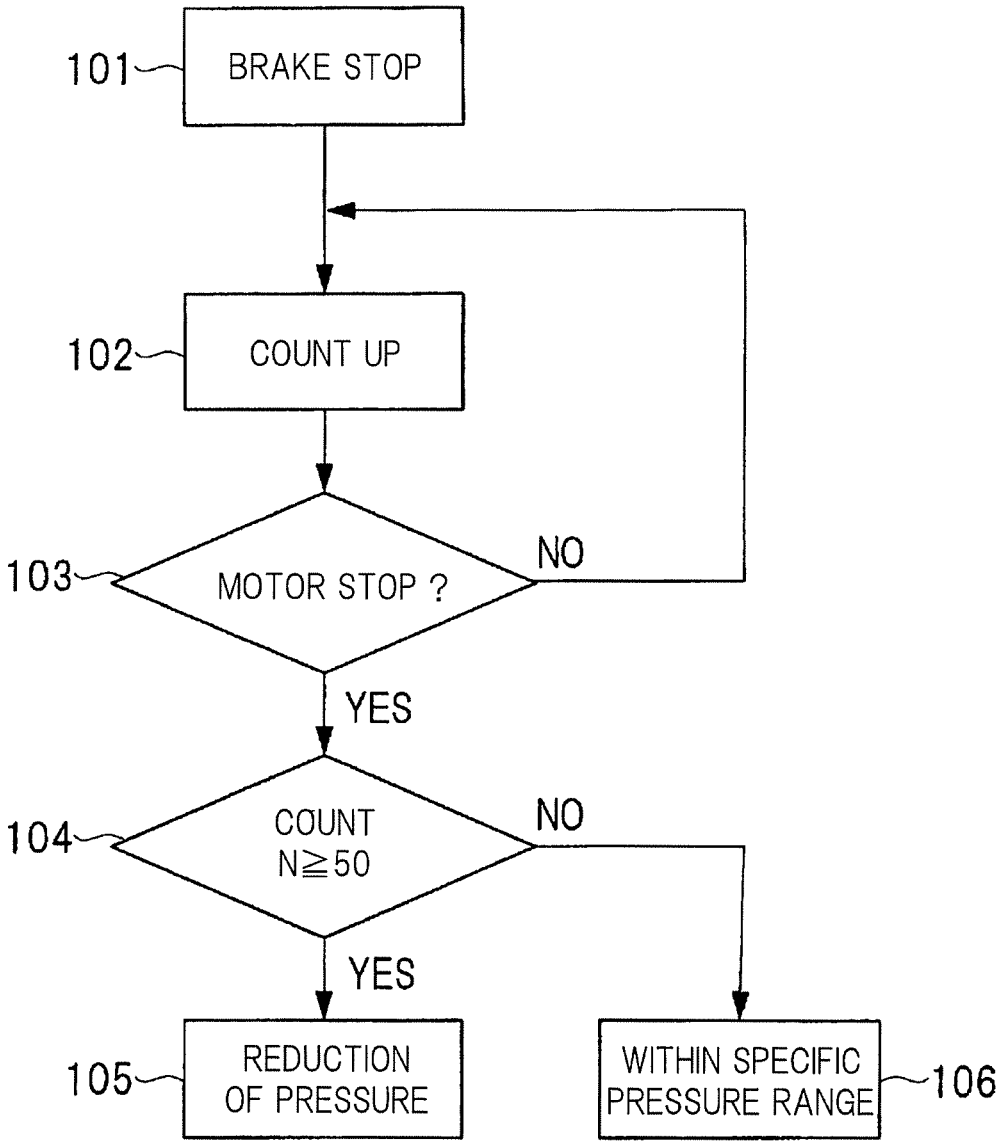
FIG. 9 is a flowchart showing an algorithm for controlling the driver by detecting a rotation state until the electric motor stops.

Next, a series of flows for estimating the pressure and performing control by detecting the rotation state until the electric motor 20 stops will be described with reference to FIG. 9. When the brake stop in step 101 is defined as a state in which the power supply to the electric motor 20 is stopped at a predetermined reference position, the rotation amount of the electric motor 20 by the inertial force from the brake stop in step 101 is measured (count up: in step 102) on the basis of a signal output from the Hall element 84 that detects the position of the rotor of the electric motor 20. The measurement is repeated until the electric motor 20 stops (in step 103). After the supply of electric power to the electric motor 20 stops (brake stop), the magnitude of pressure in the piston chamber 12 acting in the direction against the rotation of the electric motor 20 is estimated by determining whether or not the motor rotation speed exceeds a predetermined rotation speed, for example, 50 (in step 104), and when the electric motor 20 rotates at a predetermined rotation speed or more, it is determined that the pressure has dropped (in step 105). When the number of revolutions of the electric motor 20 is less than or equal to the predetermined number of revolutions, it is determined that the pressure is within the predetermined range (in step 106).

When it is determined that the pressure has dropped (in step 105), the controller 70 determines that the pressure required for driving is insufficient, and does not supply power to the electric motor 20 even when the user issues a driving operation instruction (by inputting a trigger switch signal and a push switch signal to the controller 70). In addition, when it is determined that the pressure has dropped (in step 105), a configuration may be adopted in which a state in which the pressure has dropped is notified by a user notification means (not shown), for example, lighting of an LED lamp or the like, a buzzer, or the like, or a configuration may be adopted in which the state in which the pressure has dropped is notified after restricting a driving operation instruction by the user.

In addition, when it is determined that the pressure has dropped (in step 105), a configuration may be adopted in which a state in which the pressure has dropped is notified by a user notification means (not shown), for example, lighting of an LED lamp or the like, a buzzer, or the like, or a configuration may be adopted in which the state in which the pressure has dropped is notified after restricting a driving operation instruction by the user.

As a result, it is possible to control the operation of the driver in response to a change in situation that affects the rotation amount of the electric motor 20, that is, the moving speed of the piston from the bottom dead point to the top dead point, and it is possible to suppress a problem caused by insufficient pressure in the piston chamber 12, for example, a problem that the nail is not driven to a sufficient depth due to insufficient nail driving force, and the nail head protrudes from the surface of the driven material.

In the present embodiment, the pressure drop is exemplified as an estimate example of pressure change, but the present invention can be applied even when the pressure rises. In this case, it may be detected that the inertial rotation number of the motor 20 due to the inertial force is smaller than a predetermined rotation number. For example, it may be used in applications such as temporarily suppressing the operation or informing the user when the pressure of the piston chamber 12 increases due to severe operating conditions, such as continuous use near the maximum of the usable temperature range.

The present invention is not limited to the embodiments described above, and various modifications can be made without departing from the gist thereof. For example, a change in situation that affects the moving speed of the piston from the bottom dead point side to the top dead point side includes a change in pressure in the piston chamber or the pressure accumulation chamber, a change in the ambient temperature, and the like, in addition to a change in remaining battery level. Therefore, the control mode may be selected on the basis of a change in pressure or a change in the ambient temperature in place of or in addition to a change in remaining battery level. When the control mode is selected on the basis of the pressure change, a pressure sensor for detecting the pressure change in the piston chamber or the pressure accumulation chamber may be used in combination with the pressure estimate method exemplified in the example 4. When the control mode is selected based on a change in the ambient temperature, a temperature sensor for detecting a change in the ambient temperature is provided. Furthermore, in order to control and detect a plurality of changes such as a remaining battery level and a change in pressure, the above-described embodiments may be combined.

In the above embodiment, the method of controlling the electric motor has been described by exemplifying the PWM control, but the present invention is not limited to the PWM control, and various changes can be made as long as the effective voltage and the effective current applied to the electric motor can be controlled. For example, an actual voltage value or current value to be applied to the motor may be controlled by a variable resistor circuit or the like controlled by a controller.

EXPLANATION OF REFERENCE CHARACTERS

1: driver,
2: housing,
5*a*: trigger,
10: cylinder,
11: piston,
12: piston chamber,
13: pressure accumulator,
20: electric motor,
30: driver blade,
30*a*: tip (blade tip),
32, 32*a*, 32*b*: racks,
50 wheel,
52, 52*a*, 52*b*: pins,
60: battery,
70: controller,
80: push switch,
80*a*: push switch detecting circuit,
81: trigger switch,
81*a*: trigger switch detecting circuit,
82: control signal output circuit,
83: inverter circuit,
84: Hall element,
85: rotation position detecting circuit
86: motor rotation speed detecting circuit
87: circuit voltage
88: remaining battery level detecting circuit
89: motor current detecting circuit
90: stop switch detecting circuit
100: control board
Q1-Q6: switching element

The invention claimed is:

1. A driver comprising:
a battery;
a wheel rotationally driven by an electric motor using the battery as a power source;
a plurality of pins provided to the wheel and arranged along a circumferential direction of the Wheel;
a piston reciprocably housed in a cylinder;
a driver blade integrally reciprocating with the piston;
a plurality of racks provided to the driver blade along an axial direction of the driver blade; and
a controller configured to control a drive of the electric motor,
wherein,
when the wheel is rotationally driven, the pins and the racks are sequentially engaged with each other so as to push up the driver blade,
when the piston moves from a bottom dead point side to a top dead point side in the cylinder, and when the pins are disengaged from the racks, the piston moves from the top dead point side to the bottom dead point side in the cylinder, and the driver blade moves down,
the controller is configured to control the electric motor in response to a remaining battery level so as to suppress variation between a time required from the start of the electric motor until the piston starts to move toward the bottom dead point when the remaining battery level is smaller than a reference value, and a time required from the start of the electric motor until the piston starts to move toward the bottom dead point when the remaining battery level is larger than the reference value.

2. The driver according to claim 1, wherein
the controller is configured to control a switching element provided on a power supply line for the electric motor by PWM,
the controller has first and second starting modes as a control mode for the electric motor, in the first starting mode, a duty ratio at the time of starting the electric motor is a first value, and in the second starting mode, the duty ratio at the time of starting the electric motor is a second value higher than the first value, and
the controller is configured to start the electric motor in the first starting mode when the remaining battery level is larger than the reference value, and start the electric motor in the second starting mode when the remaining battery level is smaller than the reference value.

3. The driver according to claim 1, wherein
the controller has first and second stop modes as a control mode for the electric motor, in the first stop mode, the electric motor is stopped after a first time has elapsed since the piston moving from the bottom dead point side to the top dead point side passes through a predetermined position, in the second stop mode, the electric motor is stopped after a second time longer than the first time has elapsed since the piston moving from the bottom dead point side to the top dead point side passes through the predetermined position, and the controller is configured to stop the electric motor in the first stop mode when the remaining battery level is larger than the reference value, and stop the electric motor in the second stop mode when the remaining battery level is smaller than the reference value.

4. The driver according to claim 3, wherein the second time is set so that a stop position of the piston in the first stop mode becomes the same as a stop position of the piston in the second stop mode.

5. The driver according to claim 3, wherein the second time is set so that a stop position of the piston in the second stop mode is closer to the top dead point than a stop position of the piston in the first stop mode.

6. The driver according to claim 3, wherein the controller is configured to apply an electric brake to the electric motor to stop the electric motor.

7. The driver according to claim 1, wherein the controller has first and second stop modes as a control mode for the electric motor, in the first stop mode, the electric motor is stopped after the piston moving from the bottom dead point side to the top dead point side passes through a predetermined position and after the electric motor rotates by a first rotation amount, in the second stop mode, the electric motor is stopped after the piston moving from the bottom dead point side to the top dead point side passes through the predetermined position and after the electric motor rotates by a second rotation amount greater than the first rotation amount, and the controller is configured to stop the electric motor in the first stop mode when the remaining battery level is larger than the reference value, and stop the electric motor in the second stop mode when the remaining battery level is smaller than the reference value.

8. The driver according to claim 7, wherein the second rotation amount is set so that a stop position of the piston in the first stop mode becomes the same as a stop position of the piston in the second stop mode.

9. The driver according to claim 7, wherein the second rotation amount is set so that a stop position of the piston in the second stop mode is closer to the top dead point than a stop position of the piston in the first stop mode.

10. The driver according to claim 7, further comprising a Hall element for detecting the rotation amount of the electric motor.

* * * * *